United States Patent [19]

Wingler et al.

[11] Patent Number: 4,695,683

[45] Date of Patent: Sep. 22, 1987

[54] ELECTRIC APPLIANCE TIMER WITH AUTOMATIC TURN OFF

[75] Inventors: William C. Wingler, Boylston; Edward V. Pomponio, Milford, both of Mass.

[73] Assignee: Telechron, Inc., Ashland, Mass.

[21] Appl. No.: 888,969

[22] Filed: Jul. 23, 1986

[51] Int. Cl.[4] ..... H01H 43/00; H01H 7/08

[52] U.S. Cl. ..... 200/38 R; 200/35 R; 200/38 A; 200/38 F; 200/38 FB

[58] Field of Search ..... 200/35 R, 35 A, 35 B, 200/35 H, 35 W, 36, 37 R, 37 A, 38 R, 38 A, 38 FA, 38 FB, 38 B, 38 BA, 38 C, 38 CA, 38 D, 39 R, 39 A, 153 P, 153 PA

[56] References Cited

U.S. PATENT DOCUMENTS

| | | | |
|---|---|---|---|
| 3,138,674 | 6/1964 | Boyles | 200/38 FB |
| 4,242,547 | 12/1980 | Hashimoto | 200/38 FA X |
| 4,414,439 | 11/1983 | Pomponio | 200/38 FB X |
| 4,599,499 | 7/1986 | Duve | 200/153 PA X |

*Primary Examiner*—J. R. Scott

*Attorney, Agent, or Firm*—Wolf, Greenfield & Sacks

[57] ABSTRACT

A timer assembly automatically turns off an appliance to which it is connected within a predetermined time period after the appliance has been automatically, or manually, turned on. The timer assembly includes a three-position selector mechanism with rotating cams that activate a plunger to control the operation of an electrical switch which, in turn, activates or deactivates the appliance. Rotation of the selector mechanism is controlled by a clockwork assembly which rotates the selector into a position to turn on the appliance at a predetermined set-time. When the selector is rotated into its "on" position, a gear connected to the selector engages a drive gear which is, in turn, connected to the clockwork assembly. The drive gear continues the rotation of the selector so that after a predetermined time interval, the appliance is turned off. The drive gear is connected to the clockwork assembly by a friction clutch which allows the selector to be manually set to its "on" position without affecting the clockwork assembly.

16 Claims, 13 Drawing Figures

ELECTRIC APPLIANCE TIMER WITH AUTOMATIC TURN OFF

BACKGROUND OF THE INVENTION

This invention relates to an improved appliance timer which uses commercially-available electric switches and can be actuated either manually or by a timing mechanism and which automatically deactuates after a predetermined period of time.

Electric timers are widely used in today's household appliances, for example, coffee makers and clock radios, for automatically turning on the appliance at a predetermined time. A typical timer includes a clock and a three-position selector having the usual "auto", "on" and "off" positions. The appliance can be immediately turned on manually by moving the selector from the "off" to the "on" position, or can be automatically turned on at a preset time by positioning the selector to the "auto" position and setting an indicator hand on the clock to the desired time.

Conventional timers of this type are described in U.S. Pat. Nos. 3,138,674 to Boyles, 3,432,625 to Polonsky et al., and 4,414,439 to Pomponio. The Boyles patent shows a conventional clockwork mechanism comprising a motor, timing gear train indicating hands and an electric switch which can be actuated at a selectable time. The set-time is selected by a selector knob connected to a shaft which moves the relative positions of a pair of gears, one of which is set manually and the other of which is driven by the timing gear train. The gears are located parallel to each other and have cams on their facing surfaces. At a predetermined relative position, the gears are forced apart by the cams to unlatch a spring-biased selector arm which closes the switch.

The timing device shown in the Polonsky patent also uses a gear train and timing gear pair in a similar manner to the Boyles timer. However, in the Polonsky device, the gears are held separated by a tooth in one gear which, at the selected time, fits into a slot in the other gear, allowing the gears to slide together. The electrical switch is integrated with the selector knob shaft and is spring-biased in an "on" position. An arm connected to the shaft latches onto one of the timing gears and holds the shaft rotated so that the switch remains open. The arm is released, allowing the shaft to rotate and to operate the switch when the gears slide together.

While the Boyles and Polonsky devices are simple and reliable, they suffer from a defect in that the switch mechanism is an integral part of the clockwork timer mechanism and, thus, they cannot use commercially-available switches. Consequently, once the mechanism has been fabricated, it is impossible to substitute electrical switches of different amperage rating or change the switch from a "normally-on" operation to a "normally-off" operation.

To remedy this defect other prior art switches were designed which could be used with commercially-available electric switches. For example, the Pomponio patent shows an electric timer which has a mechanism which can directly actuate a commercially-available microswitch. The mechanism is arranged so that the switch can easily be replaced so that switches with different characteristics can be integrated into the basic clockwork mechanism after fabrication.

The Pomponio apparatus incorporates the basic timing apparatus of the Polonsky patent, but uses a conventional microswitch operated by a cam follower. The cam follower is, in turn, actuated by cams located in a cup that is connected to the selector knob shaft. The cup can be rotated by the shaft to cause the cams to open the switch. The cup is also connected to and controlled by an arm which interacts with the timing gears in a manner similar to the arm in the Polonsky patent and holds the cup so that the switch remains open. At the selected time, the timing gears slide together, releasing the arm and allowing the cup to rotate into a position in which the cam/cam follower arrangement actuates the microswitch.

While improvements have been made to the mechanism for automatically actuating the switch, once the switch has been actuated and the associated appliance has been turned on, the timer mechanism is disengaged and no longer controls the appliance. Thus, if the user forgets to manually turn off the appliance, it will remain on indefinitely, which wastes energy and may present danger of a fire or other hazard.

Accordingly, it is an object of this invention to provide a timer mechanism which automatically deactivates the electric switch after a predetermined time lapse.

It is another object of this invention to provide a timer assembly which permits both manual and timed actuation of the switch yet automatically deactuates the switch after a predetermined period of time.

It is still another object of this invention to provide a timer mechanism with an automatic turn off which is simple and reliable.

It is a further object of this invention to provide a timer mechanism with an automatic turn off which is easy to manufacture.

It is yet another object of this invention to provide a timer mechanism with an automatic turn off which can be used with commercially-available electric switches.

SUMMARY OF THE INVENTION

The foregoing problems are solved and the foregoing objects are achieved according to the present invention by a timer assembly for controlling an electrical device which includes a motor, a clockwork gear train rotated by the motor, means for determining a set-time, an electrical switch controlling the device, and means connected to the gear train for actuating the switch at the set-time. According to the invention, the assembly further includes means responsive to the rotation of the gear train for deactuating the switch within a predetermined time interval after the deactuating means has been started, and means responsive to the actuation of the switch for starting the deactuating means. Preferably, the deactuating means consists of an interval means connected to an actuator which is engageable with the gear train for further moving the actuator to deactuate the switch. Preferably, the starting means consists of a driving gear assembly engaged with the gear train.

In a preferred embodiment, the timer assembly includes cams connected to a selector shaft which actuate the electrical switch. During an automatic on operation, the cams are manually rotated to deactuate the switch and later automatically released by the timing gear mechanism to actuate the switch. Upon release, the cams are rotated by a drive mechanism connected to the timing gear train. Thus, after the switch has been actuated by release and rotation of the cams, the cam assembly continues to rotate and, after a predetermined time lapse, the cams deactuate the switch. The cams are connected to the timing gear train by a friction-clutch mechanism which permits the cams to be manually rotated to the actuated position, but still allows the mechanism to subsequently deactuate the switch.

More particularly, the cams are housed in a cup connected to the selector knob shaft and the cup can be rotated to cause the cams to actuate or deactuate the switch. When the selector knob and cup are rotated in one direction to place the apparatus into an automatic actuation mode, the cams move into a position at which the switch is deactuated. The cup and cams are held in this position by an arm which latches on the timing gears.

After a preselected time interval, the timing gears release the arm and allow the cup and cams to rotate in an opposite direction into an "on" position in which the cams actuate the switch. In the "on" position, the cup has a sector gear on its outside surface which engages a friction clutch assembly which is connected to and rotates with the timing gear train. The sector gear causes the cup to continue to rotate in the opposite direction turning the selector shaft until it reaches an "off" position and the cams deactuate the switch.

The time-setting assembly includes a motor, a timing gear driven by the motor, and a manually-rotatable time setting gear which rotates on the same shaft as the timing gear. The timing gear slides on the shaft and is separated from the setting gear by a tooth on the setting gear. At one rotational position, the tooth fits into a slot on the timing gear, allowing the gears to snap together. The cup containing the cams has an arm which latches on the timing gear and is released when the timing gear snaps against the setting gear.

When the arm is released a biasing spring which forces the cam follower against the cams causes the cup to rotate, in turn, allowing the cam follower to operate the switch. The sector gear which rotates with the clockwork mechanism continues rotating the cup which eventually causes the cam to deactuate the switch. The cam follower latches into a detent on the cams in the "off" position.

The sector gear is driven by a spring-biased clutch gear pair. The clutch spring bias may be overcome by a predetermined amount of force applied to the selector shaft to allow the cup and sector gear to be manually placed in the "on" position.

DETAILED DESCRIPTION OF THE PREFERRED EMBODIMENT

Figure 1:
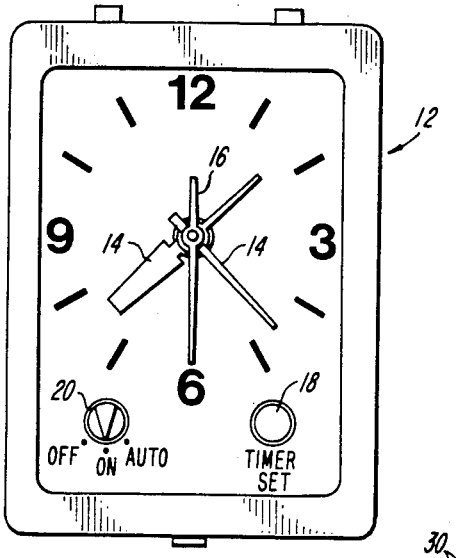
FIG. 1 PRIOR ART
FIG. 1 is a front elevation view of a clock having a three-position timed switch in accordance with the invention.

Referring to FIG. 1 of the drawing, the timer assembly of this invention includes a clock face 12 having conventional time-indicating hands 14 and a set-time indicator hand 16. A rotatable shaft 18 is provided at the front of the timer for setting both hands 14 and set-time indicator hand 16. In a conventional fashion, simply rotating shaft 18 moves set-time hand 16, while depressing and rotating shaft 18 moves time-indicating hands 14. The assembly also includes a selector shaft 20 with a beveled face constituting an indicator arrow. Shaft 20 can be rotated into one of three positions: "off", "on" and "auto".

In the illustrative embodiment, the operation of the timer assembly will be described in connection with a "normally-on" switch which is used with a "timed-on" application. However, the assembly may also be used with a "normally-off" switch to provide a "timed-off" application. In this latter case, the corresponding selector shaft positions would be labelled as "on", "off" and "auto", respectively. Commercially-available microswitches of any required amperage rating can be used with the inventive mechanism.

Figure 2:
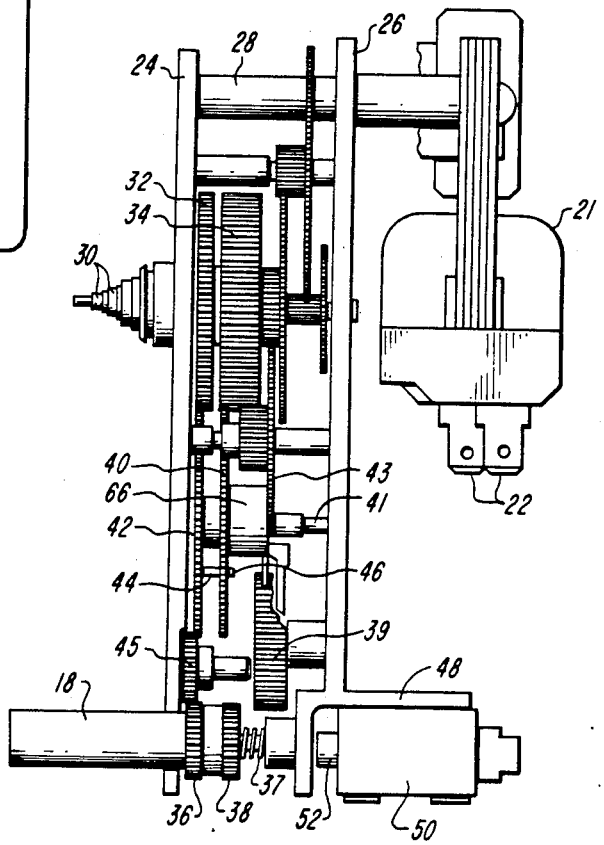
FIG. 2 PRIOR ART
FIG. 2 is a side elevation view, partially in section, of the clock drive mechanism.

Referring to the side view of FIG. 2, portions of the clockwork drive mechanism are shown. The clockwork gears are supported by, and aligned between front and back frame plates 24, 26 which are spaced apart by pillar blocks 28 in well-known clockwork construction. The gears are connected to, and driven by, an electric motor 21 by means of a splined shaft (not shown) in a conventional manner. Motor 21 receives power, also in a conventional manner, via a pair of electrical contacts 22 and operates the gears as a conventional gear train. The gear train reduces the rotational speed of the motor to approximately two rotations per day—the speed necessary to operate the shaft members 30, on which the time-indicating hands 14 are press-fitted (FIG. 1).

The clockwork gear train includes a pair of co-axial gears 32, 34. Gear 34 is affixed to shafts 30 by a well-known friction drive mechanism and rotates with the shafts as driven by motor 21. Gear 32 is not affixed to shafts 30 but freely rotates about the shafts and, in particular, may be rotated independently from gear 34. Gear 32 is not affixed to shafts 30 but freely rotates about the shafts and, in particular, may be rotated independently from gear 34. Gear 32 is connected directly to the set-time hand 16.

Depressing shaft 18, against the force of bias spring 37 causes gear 38 to engage gear 39. Rotating shaft 18 rotates time-indicating hands 14 through gears 38, 39, and 43 to set the correct time of day. Alternatively, simply rotating shaft 18 moves the set-time indicator hand 16 through gears 36, 45, 42 and 32.

A timing gear 40 and a setting gear 42 rotate about shaft 41. Setting gear 42 is permanently affixed to shaft 41, but timing gear 40 can slide back and forth with respect to setting gear 42. Gear 40 may move along shaft 41 while still being driven by gear 34, due to the added width of gear 34.

As will hereinafter be described, gear 40 is normally forced towards gear 42 by the switch arm assembly, but a projecting tooth 44 struck out of the face of gear 42 bears against the face of gear 40 and prevents the gears from sliding together. However, at one relative rotational position of gears 40 and 42, tooth 44 drops into a slot 46 which passes through timing gear 40 allowing the gears to slide together and unlatch the automatic timer mechanism as described below. The foregoing timing mechanism and clock face as shown in FIGS. 1 and 2 is conventional and fully described in U.S. Pat. No. 3,432,625 to Polonsky et al. and U.S. Pat. No. 4,414,439 to Pomponio, which are incorporated herein by reference.

A shelf 48 extends from back plate 26 and attached to shelf 48 is a conventional microswitch 50 having a depressible button 52 for actuating the switch. In the illustrative embodiment, a "normally-on" switch is used so that depressing button 52 activates or turns "off" the switch and, accordingly, turns off any electric appliance connected in series with the switch A selector mechanism, designated generally as 54 (shown in detail in FIGS. 3–6), includes a cylindrical cup 56 with one closed end and one open end. Cup 56 has a resilient latching arm 58 and a sector gear 60, each extending radially outward from the cup and located adjacent to the open end. The angular positions of the arm 58 and sector gear 60 are approximately 90° apart.

Cup 56 is connected on its closed end to selector shaft 20 which, in turn, passes through a hole in the front plate 24. The open end of cup 56 is supported by a circular flange 62 projecting from the back plate 26 on which the inner circumferential wall surface 82 of the cup rides.

Figure 11:
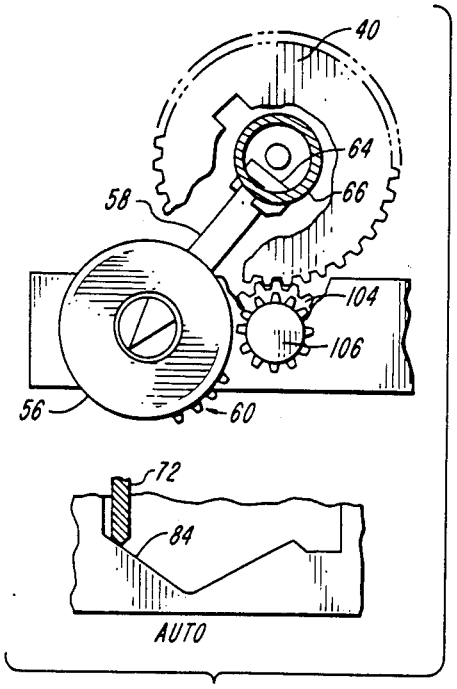
FIGS. 11, 12, and 13 are schematic drawings illustrating the "auto", "on" and "off" positions of the timer switch assembly.

Latching arm 58 has a projection 64 on its outer end, which projection is arranged to drop into a cup detent 66 on the timing gear 40 when the automatic latching arm 58 is rotated into the "auto" position (see FIG. 11). When projection 65 drops into cup 56, the resiliency of latching arm 58 provides the spring bias to force timing gear 40 toward the setting gear 42 and to slide gears 40 and 42 together when the gears reach the set-time position as described in the aforementioned Polonsky et al. patent.

Figure 3:
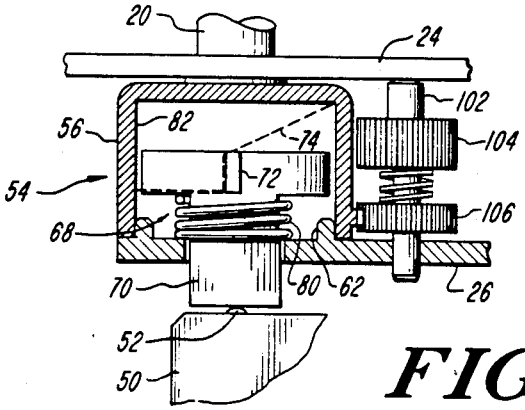
FIG. 3 is a fragmentary bottom view, partially in section, of the selector/actuator mechanism and friction gear assembly.
Figure 4:
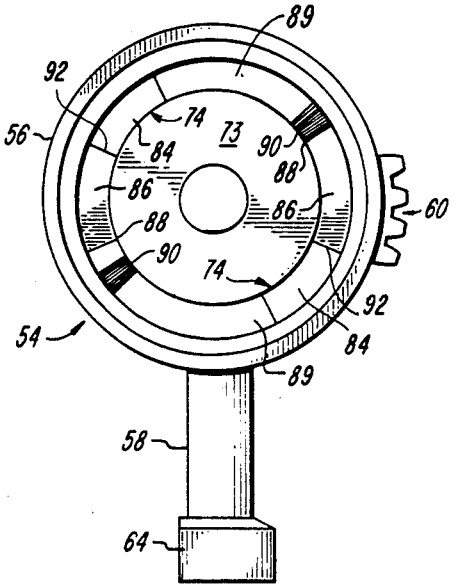
FIG. 4 is an end view of the selector.
Figure 5:
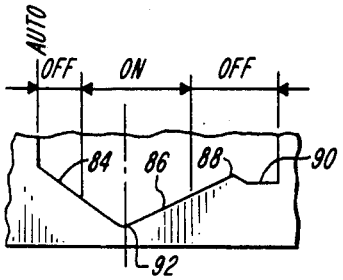
FIG. 5 is a sectional view of the cam slope in the bottom of the selector cup.
Figure 6:
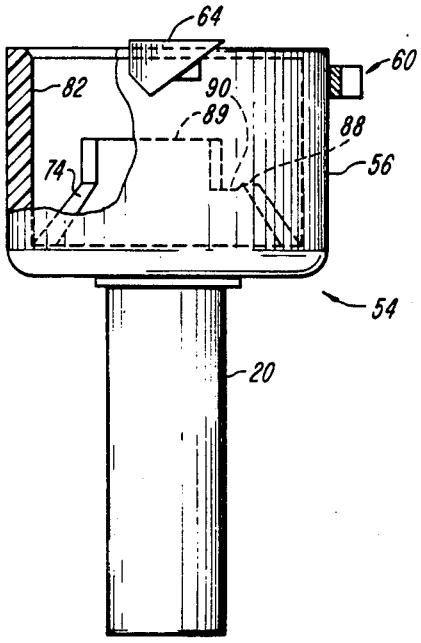
FIG. 6 is a side view, partially in section, of the selector.
Figure 7:
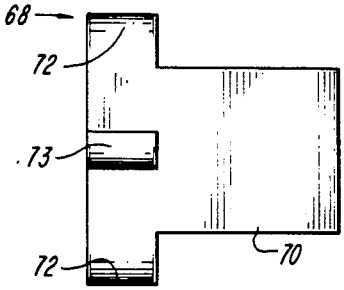
FIG. 7 is a side view of the switch actuator.
Figure 8:
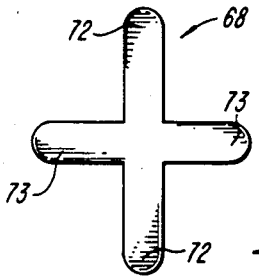
FIG. 8 is an end view of the switch actuator.

Disposed partially inside the selector cup 56 is an actuator, designated generally as 68 (shown in detail in FIGS. 3, 7 and 8). Actuator 68 includes, at one end, a plunger 70 aligned with the depressible switch button 52. At its opposite end, actuator 68 has four arms at 90° to one another, including a pair of diametrically-opposed rounded cam followers 72 and a pair of diametrically-opposed rounded arms 73. Arms 73 are sized to fit within the cylindrical cavity located between diametrically-opposed shoulders 89 on the inner wall of the cup to stabilize the actuator 68 in the cup 56. The cam followers 72, which are longer than arms 73, are sized to ride on the cam surfaces 74, as described hereinafter. The actuator slides easily into and out of cup 56 as cam followers 72 travel along cam surfaces 74 and plunger 70 projects through slot 78 in back plate 26 to engage button 52. Plunger 70 has a rectangular cross-section and slot 78 in back frame plate 26 receives plunger 70 to prevent it from rotating and thus serves as a guiding means for the actuator assembly. A compression spring 80 is located around plunger 70 between cam followers 72 and plate 26 and biases the actuator 68 longitudinally away from switch button 52.

Cam followers 72 are positioned to engage cam surfaces 74 which extend around the bottom interior edge of cup 56. Cam surfaces 74 are arranged as ramps which are inclined in an axial direction. The cam slope layout is shown in cross section in FIG. 5 and a pair of identical cam slopes are disposed on opposite sides of cup 56, one for each of the pair of the diametrically-opposed cam followers 72. The cam slope is essentially V-shaped including a pair of angled surfaces 84 and 86 which meet at a lowermost point 92. The upper end of surface 84 defines the "auto" position. At the upper end of surface 86 a projection 88 and trough 90 comprise a detent which captures and holds cam follower 72 in the selector "off" position. The lowermost point 92 of the V and adjacent portions of surfaces 84 and 86 define the center "on" position. Consequently, when the selector is rotated away in either direction from the "on" position, actuator 68 will be lifted out of cup 56 to actuate switch 50 and open the electrical circuit.

Figure 12:
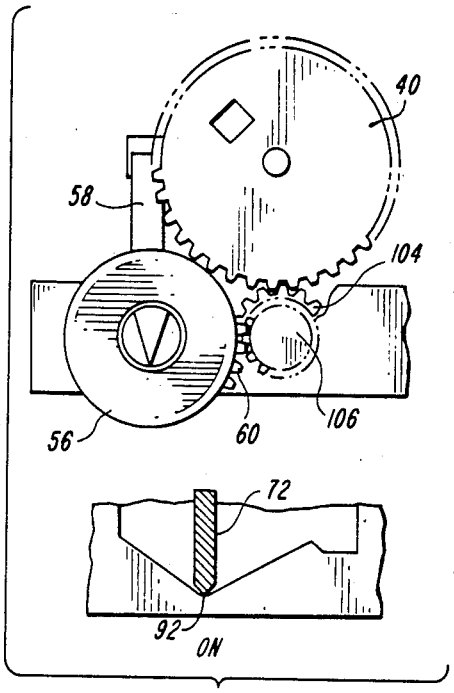
Figure 13:
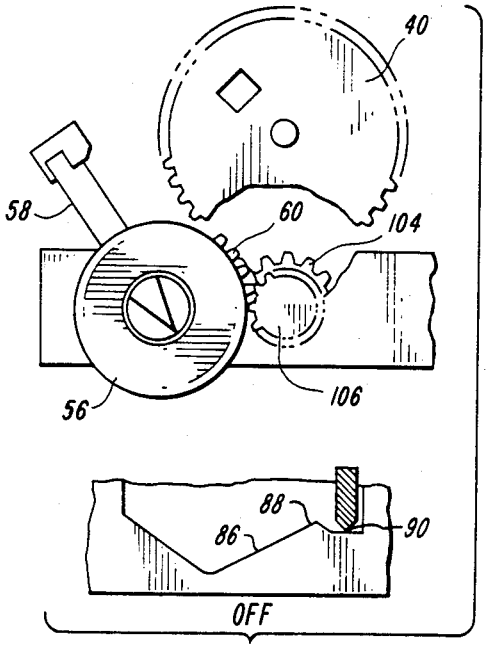

Referring now to FIGS. 11–13, one of cam followers 72 is shown riding the cam slope to define the three selector positions. The position of the elements when the selector is in the "auto" position is shown in FIG. 11, where the selector is rotated in the counterclockwise direction from the "on" position. As the selector is turned to this position, cam follower rides on the inclined cam surfaces and, as described above, turns off the associated electric appliance. In the "auto" selector position, cam follower 72 is positioned at the upper end of cam surface 84 and maintains the associated appliance off.

As the selector is being turned into its "auto" position, projection 64 rides over the edge of cup 66 on gear wheel 40 and drops into the cup. Thus, arm 58 latches cup 66 in the "auto" position until the set-time is reached and timing and setting gears 40 and 42 slide together as previously described. The movement of timing gear 40 allows projection 64 to leave cup 66 and arm 58 is released. Once arm 58 is released, the force of actuator spring 80 pressing cam followers 72 against the sloping cam faces causes cup 56 to rotate in order to return cam followers 72 to the lowermost cam position at point 92 which is located at the selector "on" position. In this position plunger 70 moves away from button 52, deactivates switch 50, and turns on the associated appliance (assuming a "normally-on" switch is used).

As the selector is rotated in the clockwise direction to the "off" position shown in FIG. 13, cam followers 72 ride up the slopes of the cam surfaces and actuator 58 is forced out of cup 56, eventually turning off the associated appliance when sufficient force has been applied to a switch button 52 to activate the "snap action" of a conventional microswitch. When the selector reaches the "off" position, cam followers 72 drop into trough 90 and are retained therein by projection 88.

Figure 9:
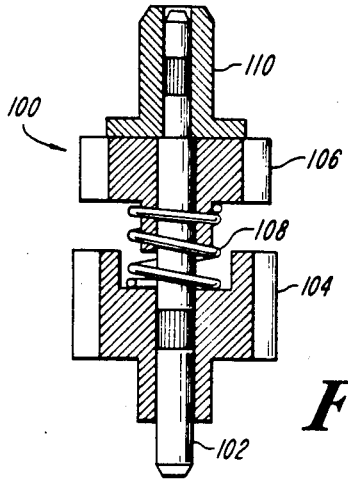
FIG. 9 is a side sectional view of the friction gear assembly.

According to this invention, the cup 56 is modified and a friction gear assembly shown in FIG. 9 is provided to automatically turn off an associated appliance after a predetermined time interval after the appliance has been turned on (either manually or by means of the timer gears). The friction gear assembly 100 cooperates with the sector gear 60 on cup 56 for automatically turning the selector from the "on" position to the "off" position within a preset time. Sector gear 60 defines an interval means defining the predetermined time interval after which the appliance is turned off.

Friction gear assembly 100 includes a shaft 102, a drive gear 104 permanently affixed to the shaft, a driven gear 106 rotatably mounted on the shaft, a a clutch plate 110 permanently attached to shaft 102, and a tension spring 108 which forces driven gear 106 against clutch plate 110.

Figure 10:
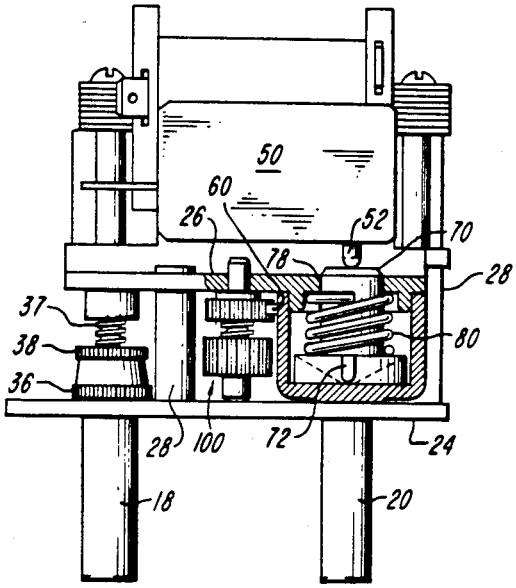
FIG. 10 is a bottom view, partially in section, of the selector/actuator and friction gear assemblies.

As shown in FIG. 10, friction gear assembly 100 is positioned adjacent selector cup 56 and is supported between the front and back frame plates 24 and 26. Timing gear 40 engages drive gear 104 so that shaft 102, drive gear 104 and clutch plate 110 continuously rotate together along with the clockwork mechanism. Under normal conditions, driven gear 106 also rotates with the rest of the assembly due to the action of spring 108.

In accordance with the invention, at any time that the selector is in the "on" position driven gear 106 engages sector gear 60 on cup 56 as shown in FIG. 12. Thus, cup 56 is driven by the clockwork mechanism, via gear 106, in a clockwise direction toward the "off" position. As mentioned previously, this rotation causes the cam followers to ride up the cam faces and eventually turn off the associated appliance. In the illustrative embodiment, the rotational speed of the drive gears is chosen so that the associated appliance is turned off approximately three hours after the selector is turned to the "on" position. After the selector has been turned to the "off" position, the cam followers drop into the detents on the cams, latching the mechanism in this state. In the "off" position, sector gear 60 is disengaged from the driven gear 106 so that gear 106 is free to rotate without affecting the state of the mechanism.

Due to the fact that driven gear 106 is only connected to the clockwork mechanism by friction against clutch plate 110, the selector can be manually rotated from the "off" position to either the "on" position or "auto" position even though sector gear 60 engages driven gear 106 as the selector passes through the "on" position. When manual force applied to the selector overcomes the frictional engagement between driven gear 106 and clutch plate 110 driven gear 106 is allowed to rotate without affecting rotation of drive gear 104 and shaft 102.

While a preferred embodiment of the invention has hereinbefore been described, it will be appreciated that variations of the invention will be perceived by those skilled in the art, which variations are nevertheless within the scope of the invention as defined by the claims appended hereto.

What is claimed is:

1. In a timer assembly for control of an electrical device, said timer assembly including a motor, a clockwork gear train rotated by said motor, manually-operable means for determining a set-time, an electrical switch controlling said device, and actuator means responsive to the rotation of said gear train and cooperating with said manual set-time neans for actuating said switch at said set-time, the improvement comprising:

said actuator means including means responsive to the rotation of said gear train for deactuating said switch within a predetermined time interval, means responsive to the actuation of said switch for engaging said deactuating means with said gear train, and means connected to said actuator means for maintaining said switch deactuated at the end of said predetermined time interval.

2. In a timer assembly, the improvement according to claim 1 wherein said actuator means includes a cam, means engaged with said gear train and responsive to the rotation of said gear train to rotate said cam when said set-time is reached, and a plunger having cam followers which engage the cam for operating said switch in response to rotation of said cam.

3. In a timer assembly, the improvement according to claim 2 wherein said deactuating means comprises a gear connected to said cam to rotate said cam during said predetermined time interval.

4. In a timer assembly, the improvement according to claim 3 wherein said means for engaging said gear with said gear train upon actuation of said switch comprises means for allowing movement of said cam independently of said gear train.

5. In a timer assembly for control of an electrical device, said timer assembly including a motor, a clockwork gear train rotated by said motor, manually-operable means for determining a set-time, and an electrical switch controlling said device, the improvement comprising:

a rotatable cam, means responsive to the rotation of said cam for actuating and deactuating said switch, means connected to said gear train for rotating said cam in a first direction when said set-time is reached to actuate said switch, a gear connected to said cam to further rotate said cam in said first direction for a predetermined time interval after said set-time, and means for engaging said gear with said gear train upon actuation of said switch for said predetermined time interval after said set-time.

6. In a timer assembly, the improvement according to claim 5 wherein said gear is a sector gear and said means for engaging said sector gear with said gear train upon actuation of said switch comprises a driving gear engaged with said gear train.

7. In a timer assembly, the improvement according to claim 6 wherein said driving gear comprises a drive gear engaged with said gear train, a driven gear engaged with said sector gear and a friction clutch coupling said drive gear and said driven gear.

8. A timer assembly for control of an electrical device, said timer assembly comprising a motor, a clockwork gear train rotated by said motor, manually-operable means for determining a set-time, an electrical switch controlling said device, a rotatable cam, means responsive to the rotation of said cam for actuating and deactuating said switch, means connected to said gear train for rotating said cam in a first direction when said set-time is reached to actuate said switch, a gear connected to said cam to further rotate said cam in said first direction for a predetermined time interval after said set-time, and means for engaging said gear with said gear train upon actuation of said switch for said predetermined time interval after said set-time.

9. A timer assembly according to claim 8 wherein said gear is a sector gear and said means for engaging said sector gear with said gear train upon actuation of said switch comprises a driving gear engaged with said gear train.

10. A timer assembly according to claim 9 wherein said driving gear comprises a drive gear engaged with said gear train, a driven gear engaged with said sector gear and a friction clutch coupling said drive gear and said driven gear.

11. A timer assembly for automatic or manual actuation of a switch, said timer assembly comprising, a motor, a timing gear driven by said motor, a manually-rotatable setting gear co-axially disposed and axially moveable with respect to said timing gear, means for axially shifting said timing and setting gears with respect to one another at a time selectable by rotating said setting gear, an electric switch having a depressable button to open or close said switch, an actuator longitudinally moveable and having a plunger positionable to depress said switch button, means biasing said actuator away from said switch button, a rotatable selector having an automatic latching arm and a sector gear, said selector having cam means cooperating with said actuator to move said actuator longitudinally toward said switch button upon rotation of said selector either in one rotational direction or in an opposite rotational direction, first detent means on one of said timing or setting gears cooperating with said automatic latching arm to latch said selector after it has turned in said one rotational direction and to release said automatic latching arm when said timing and setting gears are shifted axially with respect to one another, second detent means on the selector cooperating with said actuator to latch said selector after it has turned in said opposite rotational direction, and, a friction gear assembly cooperating with said sector gear for automatically rotating said selector in said opposite rotational direction when said automatic latching arm is released.

12. A timer assembly according to claim 11 wherein said friction gear assembly comprises, a rotatable shaft, a drive gear fixedly attached to said shaft and cooperating with said timing gear for causing said shaft and drive gear to rotate, a driven gear freely rotating on said shaft, and friction means for biasing said shaft and driven gear into engagement whereby said shaft and said driven gear rotate together.

13. A timer assembly according to claim 12 wherein said friction means in said friction gear assembly is adapted to be overcome by a predetermined amount of force applied to rotate said selector in said one direction so that said driven gear can be rotated separately from said shaft.

14. A timer assembly according to claim 13, wherein said friction means comprises a clutch plate attached to said shaft and a spring biasing said driven gear against said clutch plate.

15. A timer assembly according to claim 14, wherein said selector comprises a rotatable cup and said cam means comprises cam surfaces in said cup and wherein said actuator has a portion disposed in said rotatable cup wherein said selector is adapted to move said actuator longitudinally out of said cup in either direction of cup rotation.

16. A timer assembly according to claim 15 wherein said second detent means comprises a trough adjacent one end of said cam surfaces for releasably retaining said actuator at said one end of said cam surfaces.

* * * * *